US005778836A

United States Patent [19]

Sougawa et al.

[11] Patent Number: 5,778,836

[45] Date of Patent: Jul. 14, 1998

[54] DRAIN SYSTEM FOR TWO CYCLE ENGINE

[75] Inventors: Masafumi Sougawa; Kyoji Hakamata; Hisanori Genma, all of Hamamatsu, Japan

[73] Assignee: Sanshin Kogyo Kabushiki Kaisha, Shizuoka-Ken, Japan

[21] Appl. No.: 781,878

[22] Filed: Jan. 10, 1997

[30] Foreign Application Priority Data

Jan. 10, 1996 [JP] Japan ..... 8-020365

[51] Int. Cl.[6] ..... F02B 33/04

[52] U.S. Cl. ..... 123/65 P; 123/73 A

[58] Field of Search ..... 123/65 P, 73 A, 123/73 B, 73 C, 73 V

[56] References Cited

U.S. PATENT DOCUMENTS

| | | | |
|---|---|---|---|
| 3,859,967 | 1/1975 | Turner et al. | 123/73 A |
| 3,929,111 | 12/1975 | Turner et al. | 123/73 R |
| 4,359,975 | 11/1982 | Heidner | 123/73 A |
| 4,579,093 | 4/1986 | Eanes | 123/69 R |
| 4,590,897 | 5/1986 | Hundertmark | 123/73 A |
| 4,690,109 | 9/1987 | Ogasahara et al. | 123/73 A |
| 4,770,132 | 9/1988 | Sougawa | 123/73 A |
| 4,820,213 | 4/1989 | Holtermann et al. | 123/73 R |
| 4,890,587 | 1/1990 | Holtermann | 123/73 A |
| 5,555,858 | 9/1996 | Katoh | 123/73 AD |

*Primary Examiner*—David A. Okonsky

*Attorney, Agent, or Firm*—Knobbe, Martens, Olson & Bear, LLP

[57] ABSTRACT

A two-cycle engine having a plurality of combustion chambers, each chamber in communication with an air/fuel mixture delivery passage via a crankcase chamber, is disclosed. The engine includes a system for delivering fuel which precipitates out of the air/fuel mixture within the delivery passage to the combustion chambers. The system includes at least one fuel catch in the form of a trough positioned in each delivery passage and a fuel delivery passage extending from the catch to the combustion chamber.

8 Claims, 5 Drawing Sheets

DRAIN SYSTEM FOR TWO CYCLE ENGINE

FIELD OF THE INVENTION

The present invention relates to a fuel drain system for a two-cycle internal combustion engine. More particularly, the present invention is a system for catching fuel which precipitates out of an air/fuel mixture within the air/fuel delivery passages leading to the combustion chambers of the engine and which delivers that fuel to the combustion chambers.

BACKGROUND OF THE INVENTION

Crankcase compression type two-cycle internal combustion engines include at least one variable volume combustion chamber in communication with a crankcase chamber. An air and fuel mixture is delivered through a delivery passage to the crankcase chamber, and from the crankcase chamber to the combustion chamber.

The flow of the air and fuel mixture through the delivery passage to the crankcase chamber is normally regulated by a reed-type check valve. Unfortunately, some of the fuel in the air and fuel mixture passing through the passage and check valve precipitates on the wall defining the delivery passage and on the check valve. The precipitation of fuel from the air and fuel mixture causes the air and fuel mixture which ultimately reaches the combustion chamber to be leaner than desired. Further, when sufficient fuel has precipitated, large globules of it may be drawn into the combustion chamber with an incoming air and fuel charge, resulting in that charge being much richer than desired. These fluctuations in the air/fuel ratio contribute to inconsistent engine performance.

The problems associated with fuel precipitation in two-cycle, non-direct injection engines is accentuated where the engine is utilized to power an outboard motor of a watercraft. In that instance, the engine is typically mounted in the cowling of a motor which is tiltable about a horizontal axis extending along the stern of a watercraft. When the outboard motor is tilted or "trimmed," fuel which has precipitated in the passages through which the air/fuel mixture is delivered may be drawn by gravity away from the crankcase chamber towards the air inlet. This may result in multiple problems. First, the fuel may gather under the lower side of the reed valve and interfere with its operation. Second, in those instances where the air inlet or delivery passage extends from a common air plenum, the fuel may flow into the plenum and downwardly to its lowest point. The fuel which gathers in the bottom of the inlet plenum will, especially when the outboard motor is trimmed back to horizontal, be drawn into the lowermost delivery passage. This excess fuel will cause the cylinder corresponding to the lowermost air/fuel delivery passage to run excessively rich, even to the point of fouling or causing backfire.

A two-cycle engine having an improved air/fuel delivery system for delivering an air and fuel mixture without suffering from the above-stated fuel precipitation problems, is desired.

SUMMARY OF THE INVENTION

A two-cycle internal combustion engine having a drain system for collecting fuel which precipitates in the air/fuel delivery system and which delivers the collected fuel to the combustion chambers of the engine is disclosed.

The engine comprises a cylinder block having a head connected thereto and cooperating therewith to define at least one combustion chamber. The cylinder block also defines a crankcase chamber corresponding to each combustion chamber. The combustion chamber is supplied with an air/fuel mixture through a delivery passage which extends to a respective crankcase chamber for delivering an air/fuel charge therethrough.

The drain system preferably includes a fuel catch in the form of one or more troughs or notches positioned in a lower portion of each delivery passage in which precipitated fuel collects. In addition, a fuel delivery passage extends from the fuel catch to the combustion chamber for delivering precipitated fuel thereto for combustion.

Preferably, the engine is of the type having a throttle body with an inlet and outlet and throttle passage extending therethrough with a throttle plate therein. At the outlet of the throttle body is positioned a reed valve for controlling the flow of the air/fuel mixture into the crankcase chamber corresponding to a combustion chamber. Fuel is delivered via an injector into the air passing through the throttle passage of the throttle body. The fuel catch comprises a first pair of troughs extending inwardly from opposite sides of the delivery passage downstream (i.e. in the direction of the crankcase chamber) of the reed valve, and a second pair of troughs extending inwardly from opposite sides of the delivery passage adjacent the reed valve.

Still more preferably, there are at least two combustion chambers each having a throttle body passage leading to a crankcase chamber corresponding thereto, where the passages are vertically arranged. Here, the troughs on one side of both passages are preferably connected to a fuel delivery passage extending to one combustion chamber, and the troughs on the other side of the passages are preferably connected to a fuel delivery passage extending to the other combustion chamber.

In accordance with the present invention, fuel which precipitates from the air/fuel mixture in the delivery passage is collected by the fuel catches and delivered directly to the combustion chambers of the engine for combustion. The fuel is not allowed to drain backwardly to the air inlet, even when the engine is tilted when, for example, it is part of an outboard motor which is trimmed.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
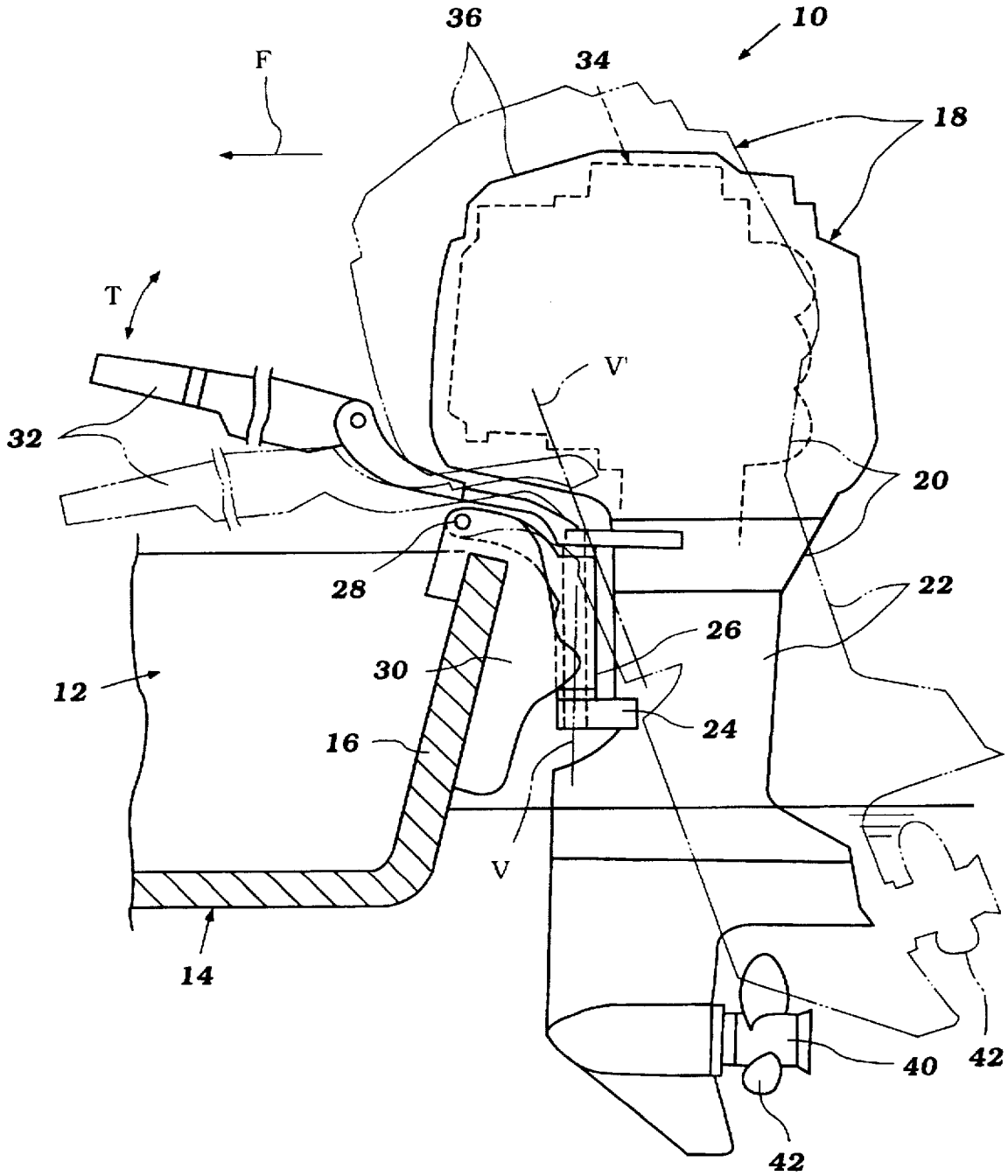
FIG. 1 is a side elevational view of an outboard motor including an engine having a fuel drain system in accordance with the present invention.

FIG. 1 illustrates an outboard motor 10 for use in propelling a watercraft 12. The watercraft 12 has a hull 14 defining a transom 16 at a stem portion thereof. The outboard motor 10 is positioned at a stem of the watercraft 12.

The outboard motor 10 preferably has a powerhead area 18 facing generally forward (in the direction F in FIG. 1). The powerhead 18 is positioned above a tray 20, which is in turn positioned above a lower unit 22. The motor 10 includes a steering shaft, not shown, affixed to the lower unit 22 by means of a lower bracket 24. The steering shaft is supported for steering movement about a vertically extending axis V within a swivel bracket 26. The swivel bracket 26 is connected by means of a pivot pin 28 to a clamping bracket 30 which is attached to the watercraft transom 16. The pivot pin 28 permits the outboard motor 22 to be trimmed and tilted up about the horizontally disposed axis formed by the pivot pin 28 in the direction of arrow T. A power tilt and trim unit 32 of any known type is provided for moving the outboard motor 22 to move upwardly to its trimmed position (illustrated in phantom, wherein the swivel axis is along a non-vertical line V') and its original position (illustrated in solid lines).

The power head 18 of the outboard motor 10 includes an engine 34 which is positioned within a cowling 36. The engine 34 is mounted in the power head 18 so that a crankshaft 38 (described in more detail below) thereof rotates about a vertically extending axis. This facilitates coupling to a drive shaft 33 (see FIG. 2). The drive shaft depends into and is journalled within a drive shaft housing portion of the lower unit 22, wherein it drives a conventional bevel gear, forward neutral reverse transmission of a known variety. The transmission drives a propeller shaft (not shown) which is journalled within the lower unit 22 in a known manner. A hub 40 of a propeller, indicated generally by the reference numeral 42, is coupled to the propeller shaft for providing a propulsive force to the watercraft hull 14 in a manner well known in this art.

The construction of the engine 34 will now be described in more detail, referring first primarily to FIG. 2. The engine 34 is preferably of the V-type and, accordingly, has a cylinder block 44 having a pair of cylinder banks 46,48 which extend at an angle relative to one another, giving the engine 34 its "V" configuration. Preferably, the engine 34 is oriented such that the cylinder banks 46,48 are positioned opposite the watercraft 12 (i.e., in the direction opposite "F" labeled in FIG. 2).

Each cylinder bank 46,48 includes a plurality of vertically arranged, parallel cylinder bores 50 which are preferably formed by cylinder liners. Preferably, each cylinder bank 46,48 includes three bores 50 such that the engine is of the "V"-6 variety. While the engine 34 preferably includes six cylinders, it should be understood that the engine may include as few as one, or more than six cylinders. In addition, the engine may be other than of the "V" type, such as inline or flat.

A piston 52 is movably mounted within each cylinder bore 50. Each piston 52 is connected via a connecting rod 56 to the vertically extending crankshaft 38. Though not illustrated in detail, the crankshaft 38 is rotatably journalled with respect to the cylinder block 44 for rotation with respect thereto.

A cylinder head assembly 58 is connected to each cylinder bank 46,48 and extends over the cylinder bores 50. The cylinder head assemblies 58 cooperate with the cylinder block 44 and the bores 50 therein to define combustion chambers 60. A cover 62 is connected to each cylinder head assembly, and has a spark plug 64 extending therethrough into each combustion chamber 60 for igniting an air and fuel mixture therein, as is well known to those skilled in the art. The spark plugs 64 may be fired by any suitable ignition system.

An induction system 66 provides the air and fuel mixture to each combustion chamber 60. Preferably, the induction system 66 comprises an intake plenum 68 having an inlet 70 and an outlet 72 in communication with an induction passage. Preferably, the induction passage is defined in part by a throttle body 75 having a number of throttle passages 74 therethrough. Air ("A" labeled in FIG. 1) flows from outside the cowling 36 through an air inlet or vent (not shown), through the interior of the cowling to the inlet 70, and into the plenum 68 and out the outlet 72. A throttle passage 74 is provided corresponding to each combustion chamber 60, there being six such passages 74 in the instant case.

The throttle body 75 is mounted to a crankcase portion 76 of the cylinder block 44 in which the crankshaft 44 rotates. A throttle plate 78 is positioned in each throttle passage 74 for controlling the flow of air through the induction system 66. Each throttle plate 78 is movable with a throttle control wire or similar throttle plate operating mechanism known in the art.

Air flowing past the throttle plate 78 in the throttle passage 78 flows into an inlet passage 80 and therebeyond through a reed-type check valve 82 into the crankcase of the engine 34. As best illustrated in FIG. 2, there is provided a separate inlet passage 80 corresponding to each cylinder, and a corresponding valve 82 for controlling the flow of the air and fuel mixture in to the crankcase. In addition, the crankcase is divided into a number of chambers corresponding to each of the cylinders, as is well known to those skilled in the art. Each reed-type check valve 82 is mounted on a cage structure 84. As best illustrated in FIG. 5, each cage structure 84 is connected to a mounting plate 86 positioned between the throttle body 75 and the crankcase portion of the cylinder block 44 and held therebetween with mounting bolts 88.

The reed-type check valves 82 will now be described in more detail in conjunction with FIG. 5. As illustrated therein, the cage 84 is generally "V"-shaped, having first and second sides having free ends which are separated from one another and connected to the plate 86 with one or more screws 90. The first and second sides are joined at a common, closed intersection 92. Each of the sides of the cage 84 have a plurality of windows 94 therethrough. A valve plate 96 extends over each side of the cage 84. The plates 96 are movable, such that in one position they obscure the windows 94 thus preventing the passage of air and fuel therethrough, and in a second position are raised up, exposing the windows 94. A stop plate 98 is connected to the cage 84 on each side thereof, but spaced away from the valve plates 96. The stop plates 98 serve to prevent over-extension of the valve plates 96.

Figure 5:
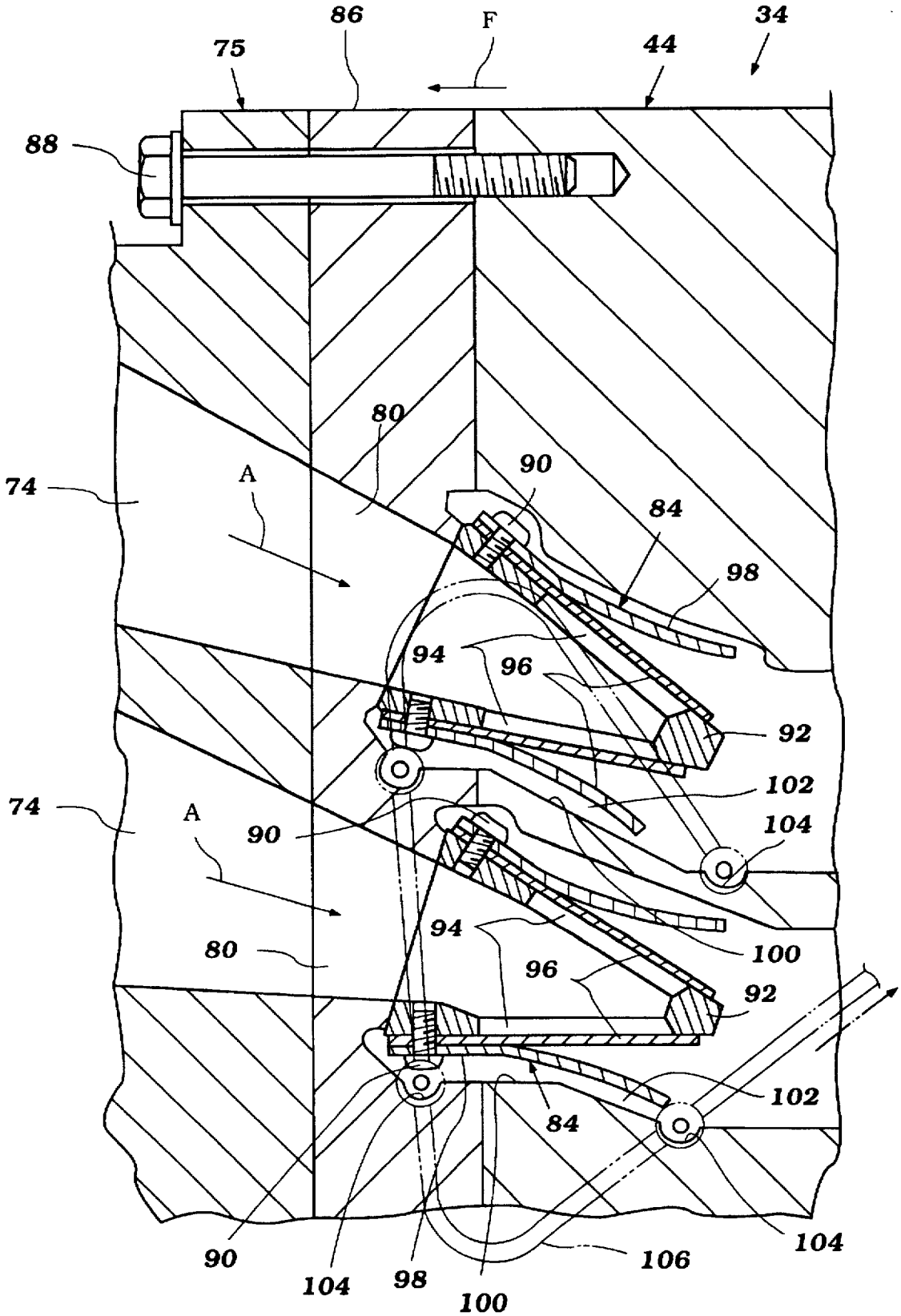
FIG. 5 is a partial cross-sectional view of the engine illustrated in FIG. 1 illustrating the fuel drain system.

As can also be seen in FIG. 5, dividing walls 100 positioned within the crankcase chamber portion 76 of the cylinder block 44 divide the crankcase chamber into separate chambers 102 corresponding to each combustion chamber 60. The inlet passages 80 which are part of the overall induction or delivery passage are formed by passages through the mounting plate 86 and the entry portion to each crankcase chamber defined by the walls 100.

Fuel 110 is delivered to the air passing through each throttle passage 74 by a fuel injector 112. The fuel 110 is delivered from a fuel reservoir (not shown) by a fuel pump or similar delivery means known in the art. This fuel 110 is delivered to a fuel rail 114 to which each injector 112 is connected. The injectors 112 deliver the fuel in metered bursts into its corresponding throttle passage 74, as illustrated in FIG. 2.

As is well known to those skilled in the art, a suitable exhaust system is provided for exhausting waste gases and unburned fuel from each combustion chamber 60 after combustion. Preferably, the exhaust system includes scavenge passages for routing some of the exhaust back to the crankcase chambers, as is well-known in the art of two-cycle engines.

Figure 3:
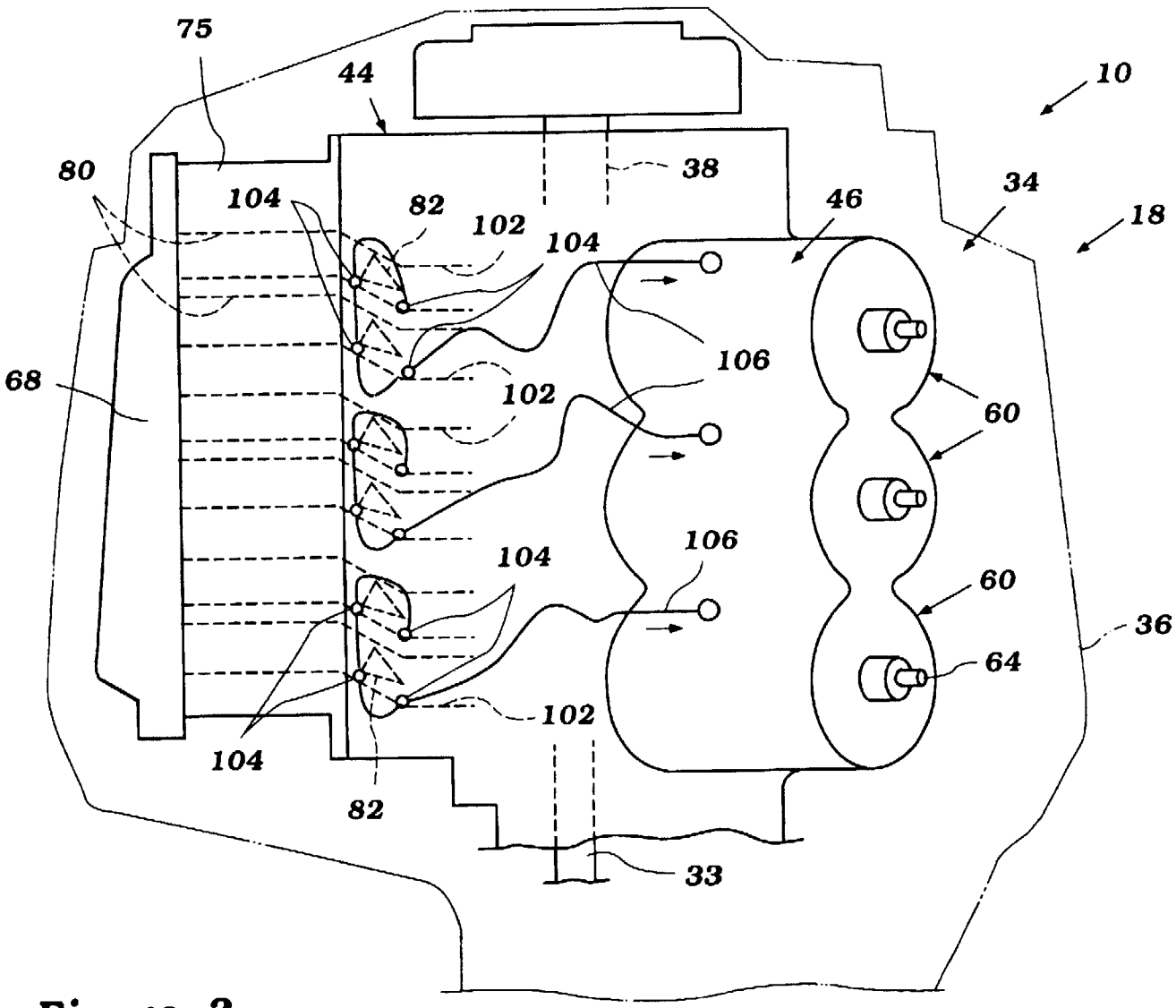
FIG. 3 is a first side view of the engine illustrated in FIG. 1.
Figure 4:
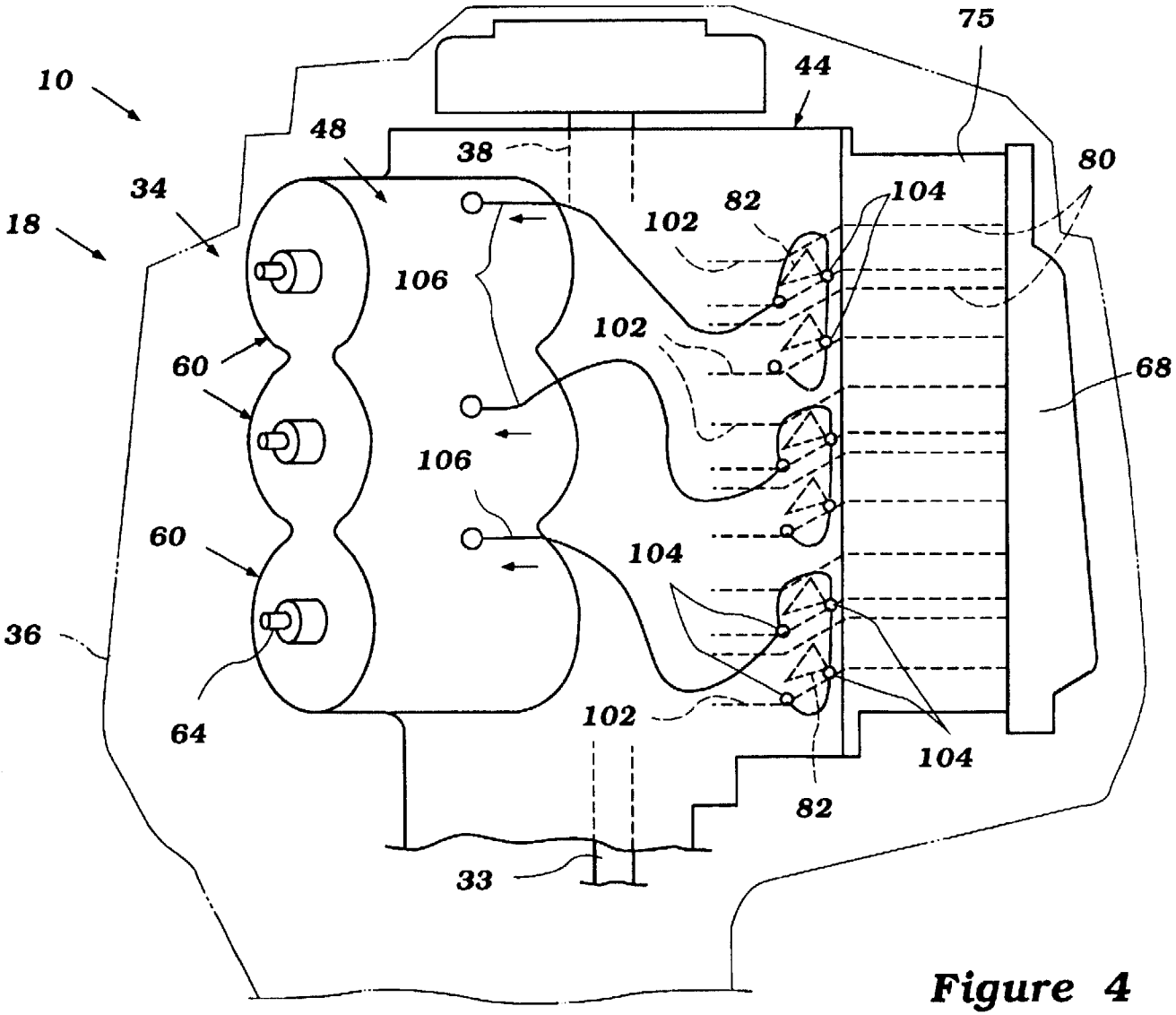
FIG. 4 is a second side view of the engine illustrated in FIG. 1.

In accordance with the present invention, the engine 34 includes a fuel-drain system for collecting fuel which precipitates out of the air/fuel mixture passing through the inlet passages 80 and for delivering this fuel to the combustion chambers 60. Preferably, this system includes a number of fuel catches 104 for trapping precipitated fuel and corresponding fuel delivery passages or lines 106 for delivering it to the combustion chambers 60. As best illustrated in FIG. 5, the fuel catches 104 preferably comprise a semi-circular notches or troughs positioned in the induction passages. In particular, the catches 104 are preferably positioned in the dividing wall 100 and the mounting plate 86. As also illustrated in FIGS. 3 and 4, the troughs comprising the catches 104 generally extend across (generally perpendicular to the passages 80) the bottom of the wall 100 and plate 86 (i.e. the catches 104 are in that portion of the delivery passage 80/crankcase chamber 102 to which gravity pulls precipitated fuel). Preferably, the catches 104 do not extend all the way across the passages, but are positioned in pairs extending party way across, as illustrated in FIG. 2. As illustrated therein, a first pair of catches 104 are positioned along the passage 80 downstream of the reed valve 82 (and formed in the wall 100), and a second pair of catches 104 are positioned below the reed valve 82 (and formed in the mounting plate 86) with those catches nearest the cylinder bores 50 extending from opposite sides inwardly a greater distance than the catches 104 positioned nearest the reed valves 82.

Each fuel passage 106 extends in communication with the catches 104 of a pair of adjacent air/fuel delivery passages. The fuel passage 106 extends therefrom along the outside of the block 44 to a passage 108 extending back through the block into the lower portion of the cylinder bore 50. In particular, the passage 108 is preferably oriented such that it is exposed when the piston 54 is at bottom dead center or very near thereto.

Figure 2:
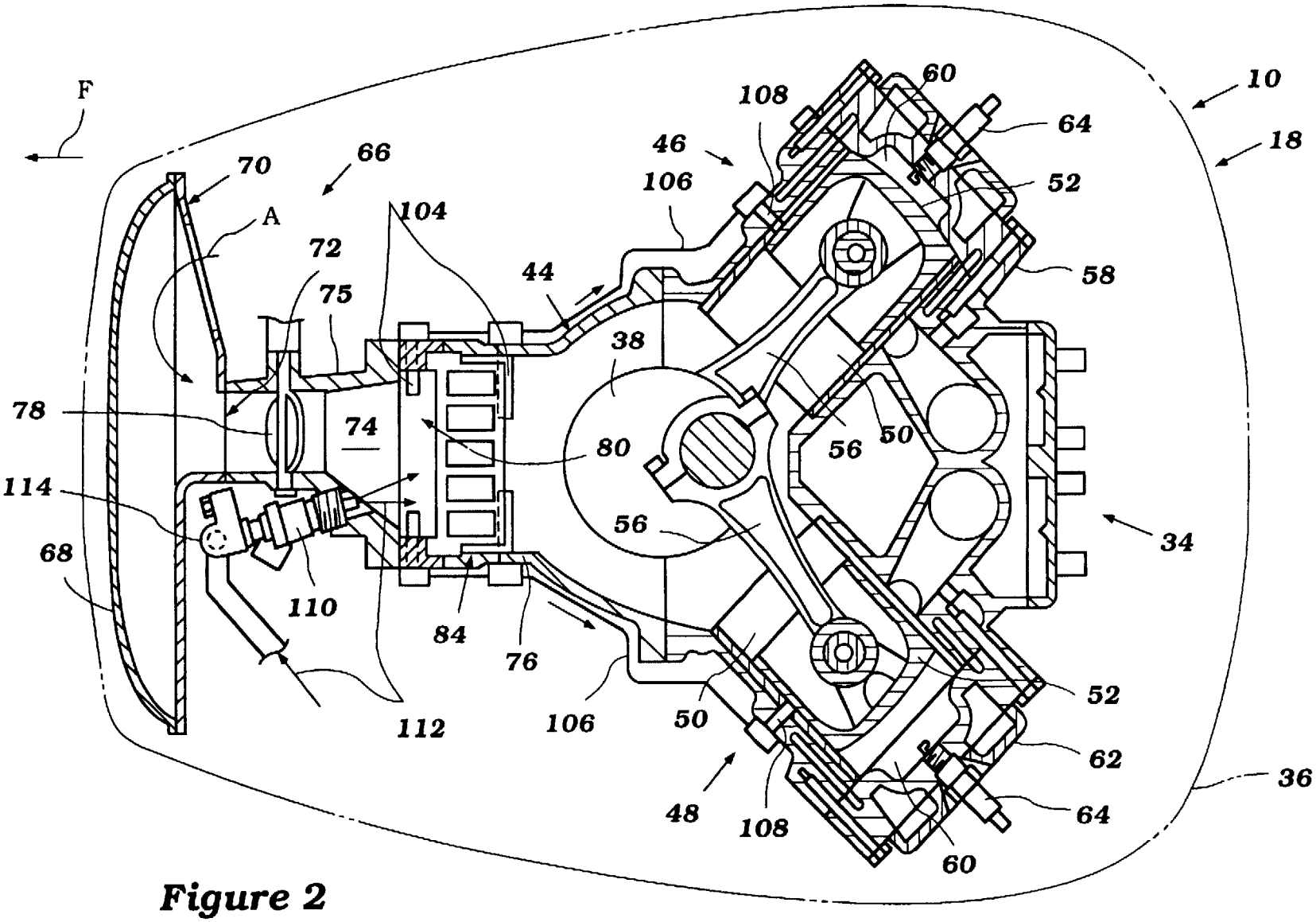
FIG. 2 is a top cross-sectional view of the engine illustrated in FIG. 1.

Each fuel passage 106 preferably comprises an opening in communication with the fuel catches 104 and an outer passage defined on the outside of the cylinder block 44 by the block and an outer wall, as best illustrated in FIG. 2. As best illustrated in FIG. 3, the top-most cylinder bore 60 of the first cylinder bank 46 has its fuel delivery passage 106 in communication with the catches 104 in its air/fuel delivery passage, as well as that of the top-most cylinder bore 60 of the second cylinder bank 48. Likewise, the top-most cylinder bore 60 of the second bank 48 has its fuel delivery passage 106 in communication with the same two air/fuel delivery passages. As illustrated therein, however, the fuel delivery lines 106 for these two cylinders are positioned on opposite sides of the engine 34, and thus draw fuel from the catches 104 located on opposite sides thereof. Likewise, the middle and lower-most cylinder bores 50 of the first and second banks 46,48 have their fuel delivery lines 106 paired.

In the above-described preferred arrangement, each fuel delivery passage 106 is in communication with four catches: two catches in each of two adjacent passages 80.

Advantageously, fuel which precipitates in the air/fuel delivery passage and on the reed valves 82 is drawn by gravity downwardly to the bottom of the passage into the catches 104. Notably, the catches 104 which are closest to the connection of the reed valves 82 to the mounting plate 86 are advantageous in collecting fuel which avoids the downstream catches 104 when the outboard motor is trimmed upwardly, thus preventing fuel from running back down the passage 80 and interfering with the reed valve 82 or flowing through the throttle passage 74 and into the plenum 68. Fuel which precipitates and is collected in the catches 104 is drawn into the fuel delivery passages 106. The drawing of the fuel from the catches 104 to the passages 106 is aided by the fact that when the piston 54 reaches bottom dead center, an area of low pressure is created in the cylinder bore 50 which, when the passage 108 is exposed, causing fuel to be drawn towards and into the bore 50. This fuel is then burned in the next combustion cycle of that cylinder.

Another advantage of the present arrangement is that corresponding cylinders of each bank 46,48 are paired to catches 104 within common inlet passages. Thus, precipitated fuel which is caught is distributed nearly equally between two common cylinders, so that no single cylinder runs excessively rich or lean corresponding to the other cylinders.

Of course, the foregoing description is that of preferred embodiments of the invention, and various changes and modifications may be made without departing from the spirit and scope of the invention, as defined by the appended claims.

What is claimed is:

1. A two-cycle internal combustion engine comprising a cylinder block having a cylinder head connected thereto and defining at least one combustion chamber, a piston movably positioned in said combustion chamber, said piston connected to a crankshaft which is rotatably journalled with respect to said cylinder block, said cylinder block defining a crankcase chamber corresponding to said combustion chamber, an induction passage having opposing sides and an inlet through which air is drawn and an outlet in communication with said crankcase chamber, fuel delivery means for introducing fuel into the air flowing through said induction passage, valve means positioned along said induction passage for controlling the flow of air and fuel therethrough, and a fuel drain system for draining fuel from said induction passage which is delivered to said air passing therethrough but which does not pass with said air to said combustion chamber, said drain system comprising at least one trough extending inwardly from each side of said passage and only partially across said induction passage and a fuel delivery line extending from said trough to said combustion chamber.

2. The engine in accordance with claim 1, wherein said induction passage is defined by a wall section within said crankcase chamber, a passage through a throttle body, and a passage through a mounting plate positioned between said crankcase chamber and said throttle body.

3. The engine in accordance with claim 1, wherein at least one trough is positioned adjacent said valve means and at least one other trough is positioned along said passage towards said crankcase chamber from said at least one first trough.

4. The engine in accordance with claim 1, wherein there are at least a first and a second combustion chamber, said first and second combustion chambers having a crankcase chamber and an induction passage leading thereto, said induction passages positioned above one another, and wherein a first fuel delivery line extends from said at least one trough extending inwardly from said first side of said passage in both induction passages to said first combustion chamber and a second fuel delivery line extends from said at least one trough extending inwardly from said second side of said passage in both induction passages to said second combustion chamber.

5. An outboard motor for use in powering a watercraft and mounted thereto in rotatable fashion, said outboard motor having an engine positioned within a cowling thereof, said engine having a cylinder block with a cylinder head connected thereto and cooperating therewith to define therein at least two combustion chambers, a piston reciprocally mounted within said chamber, said piston connected to a crankshaft journalled for rotation with respect to said cylinder block, said crankshaft having an output driving a water propulsion device of said motor, said crankshaft oriented generally vertically, said cylinder block further defining a crankcase chamber corresponding to each combustion chamber, an induction passage having an inlet and outlet, said outlet leading to said crankcase chamber, fuel delivery means for providing fuel to air passing through said induction passage, valve means for controlling the flow of an air/fuel mixture through said induction passage, and a fuel drain system for catching fuel delivered by said fuel delivery means but not delivered to said combustion chamber comprising at least a first and a second fuel catch for each induction passage a first fuel delivery conduit for delivering caught fuel from said first fuel catch of a pair of induction passages to a first combustion chamber and a second fuel delivery conduit for delivering caught fuel from said second fuel catch of a pair of induction passages to a second combustion chamber.

6. The outboard motor in accordance with claim 5, wherein said first and second fuel catches comprise at least one trough extending into said induction passage.

7. The outboard motor in accordance with claim 5, wherein said piston moves between a first top dead center position within said chamber and a second bottom dead center position within said chamber; and wherein said first fuel delivery conduit is exposed when said piston is in said second but not said first position.

8. The outboard motor in accordance with claim 5, wherein said first and second conduits are defined, at least in part, by said cylinder block.

* * * * *